US009157223B2

(12) United States Patent
Kempen et al.

(10) Patent No.: US 9,157,223 B2
(45) Date of Patent: Oct. 13, 2015

(54) LAVATORY SYSTEM

(71) Applicant: Bradley Fixtures Corporation, Menomonee Falls, WI (US)

(72) Inventors: Scott L. Kempen, Menomonee Falls, WI (US); Theodore E. Dhein, Sussex, WI (US); William L. Haas, Slinger, WI (US); Michael D. McLaughlin, Lake Mills, WI (US); Timothy E. Perrin, Hartford, WI (US); Robert Michael Piekarski, Germantown, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 269 days.

(21) Appl. No.: 13/763,034

(22) Filed: Feb. 8, 2013

(65) Prior Publication Data

US 2014/0223658 A1 Aug. 14, 2014

(51) Int. Cl.

| | |
|---|---|
| ***E03C 1/24*** | (2006.01) |
| ***E03C 1/244*** | (2006.01) |
| ***E03C 1/18*** | (2006.01) |

(52) U.S. Cl.

CPC . *E03C 1/244* (2013.01); *E03C 1/18* (2013.01); *E03C 1/24* (2013.01)

(58) Field of Classification Search

CPC ..... A47K 3/04; E03C 1/23
USPC ..... 4/619–660
See application file for complete search history.

(56) References Cited

U.S. PATENT DOCUMENTS

| | | | |
|---|---|---|---|
| D198,016 | S | 4/1964 | Kaiser |
| 5,179,740 | A | 1/1993 | Marsilio et al. |
| D434,124 | S | 11/2000 | McKeone |
| D492,015 | S | 6/2004 | Kergoet |
| D563,533 | S | 3/2008 | Kakihana et al. |
| D598,081 | S | 8/2009 | Soulier |
| D598,989 | S | 8/2009 | Kakihana et al. |
| D624,632 | S | 9/2010 | Booth et al. |
| D629,877 | S | 12/2010 | Rundberg |

FOREIGN PATENT DOCUMENTS

| | | |
|---|---|---|
| CN | 202627102 | 12/2012 |
| CN | 202672266 | 1/2013 |
| DM | DM050901 | 2/2000 |
| DM | DM072571 | 10/2009 |
| EM | 000077920-0002 | 1/2004 |
| EM | 000094727-0001 | 3/2004 |

(Continued)

OTHER PUBLICATIONS

International Search Report and Written Opinion for PCT Application No. PCT/US2014/014876, mail date Nov. 19, 2014, 15 pages.

*Primary Examiner* — Lori Baker
(74) *Attorney, Agent, or Firm* — Foley & Lardner LLP

(57) ABSTRACT

A lavatory system includes a basin configured to receive at least one faucet, the basin defining a primary drain passage and first and second overflow drain passages; and an overflow adapter configured to be mounted to a rear surface of the basin, the overflow adapter defining an adapter passage such that when the overflow adapter is mounted to the basin, fluid received by way of the first overflow drain passage is directed through the adapter passage between the overflow adapter and the rear surface of the basin and to the second overflow drain passage.

23 Claims, 5 Drawing Sheets

(56) References Cited

FOREIGN PATENT DOCUMENTS

| | | |
|---|---|---|
| EM | 000115100-0001 | 3/2004 |
| EM | 000115100-0003 | 3/2004 |
| EM | 000195987-0001 | 9/2004 |
| EM | 000176987-0001 | 11/2004 |
| EM | 000230594-0001 | 12/2004 |
| EM | 000250212-0002 | 1/2005 |
| EM | 000308671-0003 | 3/2005 |
| EM | 000308671-0004 | 3/2005 |
| EM | 000308671-0005 | 3/2005 |
| EM | 000567870-0002 | 9/2006 |
| EM | 000853320-0003 | 2/2008 |
| EM | 000868674-0002 | 9/2008 |
| EM | 001101687-0023 | 4/2009 |
| EM | 001120372-0008 | 5/2009 |
| EM | 001552837-0006 | 7/2009 |
| EM | 000759204-0007 | 10/2009 |
| EM | 000723275-0002 | 11/2009 |
| EM | 001628041-0018 | 11/2009 |
| EM | 001873332-0005 | 6/2011 |
| EP | 1 936 046 | 6/2008 |
| JP | 2001-061690 | 3/2001 |

LAVATORY SYSTEM

BACKGROUND

The present disclosure relates generally to the field of lavatory systems, and more specifically, to lavatory systems provided with an improved overflow drain and lateral profile configuration.

Typical lavatory systems such as sinks, hand washing stations, etc. may use overflow drains that are formed with separate sections of tubing or pipe, of passages that are integrally formed into a basin or other fixture or assembly. However, there are many challenges associated with typical lavatory systems.

As such, one or more embodiments herein may provide an improved overflow drain and/or lateral profile for lavatory systems.

SUMMARY

One embodiment relates to a lavatory system comprising a basin configured to receive at least one faucet, the basin defining a primary drain passage and first and second overflow drain passages; and an overflow adapter configured to be mounted to a rear surface of the basin, the overflow adapter defining an adapter passage such that when the overflow adapter is mounted to the basin, fluid received by way of the first overflow drain passage is directed through the adapter passage and to the second overflow drain passage.

Another embodiment relates to a lavatory system comprising a basin defining a primary drain passage and at least one overflow drain passage; a plurality of faucets coupled to the basin and configured to provide fluid to users of the lavatory system; and an adapter assembly coupled to a rear portion of the basin and configured to receive fluid from the at least one overflow drain passage; wherein the primary drain passage is configured to receive the fluid provided to the adapter assembly from the at least one overflow drain passage.

Another embodiment relates to an adapter assembly usable a lavatory basin to form an overflow passage, the adapter assembly comprising a body portion having a first side and a generally circular periphery; a generally circular recess defined by the first side and configured to direct fluid between first and second overflow passages of the basin; and a seal assembly provided between the recess and the periphery of the body portion, the seal assembly configured to prevent the passage of fluid from the recess and between the first side of the body and the basin.

DETAILED DESCRIPTION OF EXEMPLARY EMBODIMENTS

Referring to the FIGURES generally, a lavatory system is shown that is usable in a variety of different environments, including various public, commercial, or similar environments, to enable users of the lavatory system to, for example, wash their hands, etc. Generally, the lavatory system provides a wash area for users to wash hands using one or more faucets, soap dispensers, or other lavatory fixtures that may be mounted to the lavatory system or be otherwise accessible to users.

Figure 1:
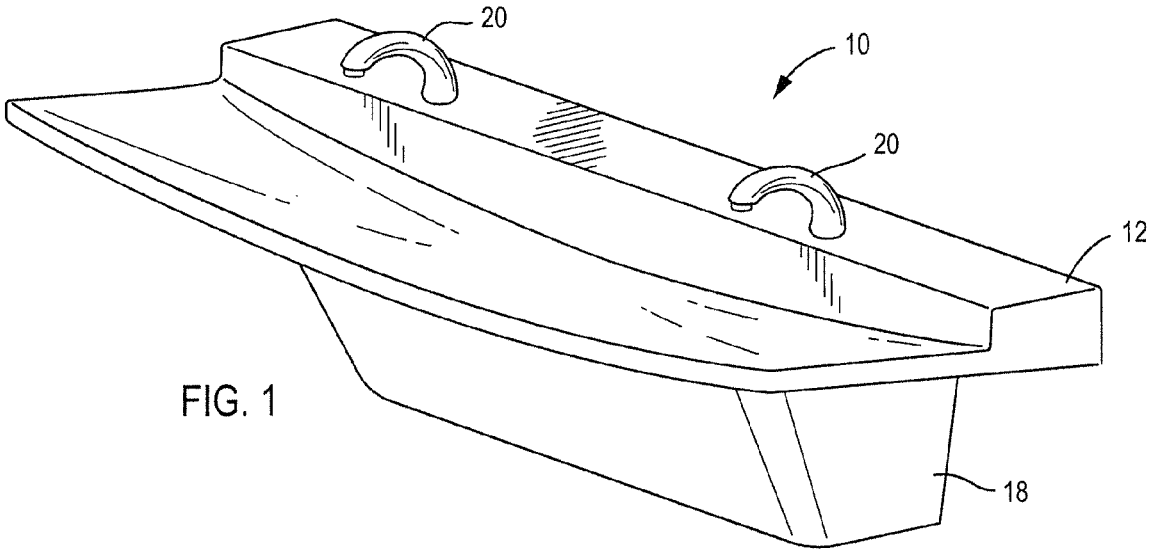
FIG. 1 is a perspective view of a lavatory system according to an exemplary embodiment.
Figure 2:
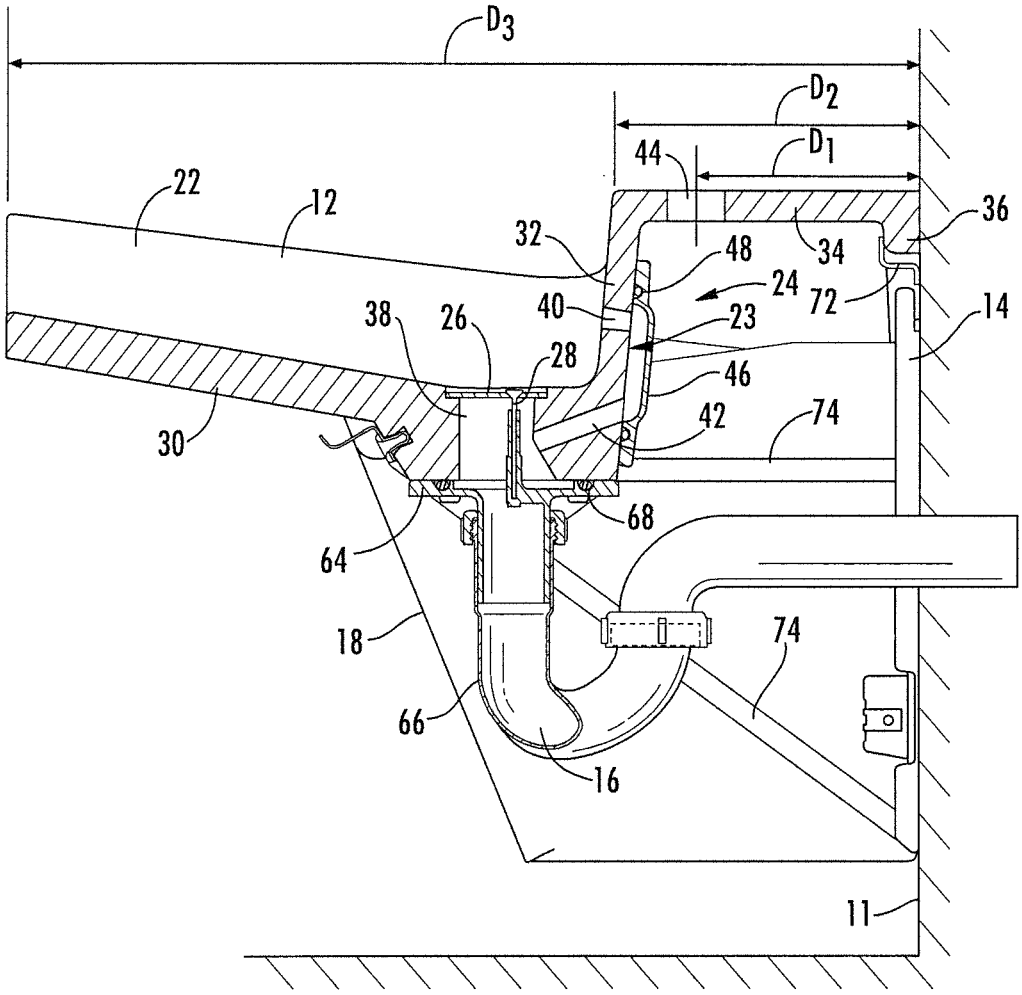
FIG. 2 is a cross-sectional view of the lavatory system of FIG. 1 according to an exemplary embodiment.

Referring to FIGS. 1-2, a lavatory system 10 is shown according to an exemplary embodiment. Lavatory system 10 includes a basin assembly 12, a mounting assembly 14, a drain assembly 16, and a cover assembly 18. Furthermore, lavatory system 10 may include one or more fixtures 20 (e.g., faucets, sprayers, soap dispensers, etc.) mounted thereto. Various additional fixtures (e.g., hand dryers, etc.) may be mounted to the lavatory system or be otherwise accessible to users. More or fewer components may be used in connection with lavatory system 10 according to various other embodiments.

In one embodiment, basin assembly 12 is mounted to a wall 11 (e.g., a bathroom wall, etc.) or other structure by way of mounting assembly 14. Mounting assembly 14 may include a mounting structure 70, one or more mounting brackets 72, support members 74, or other mounting components. Any suitable mounting components may be used to securely mount lavatory system 10 to a wall or other suitable structure.

Basin assembly 12 is configured to receive water, soap, etc. from one or more fixtures that may be mounted to basin assembly 12, and direct the water, soap, etc. to drain assembly 16. Drain assembly 16 in turn directs the materials to a conventional drain system (e.g., as part of a commercial building, etc.). While lavatory system 10 is shown in the FIGURES as generally having a single drain assembly 16, according to various other embodiments, multiple drain assemblies may be incorporated into a single lavatory system and be usable in connection with a single basin assembly.

Cover assembly 18 may be used to conceal one or more portions of basin assembly 12, mounting assembly 14, drain assembly 16, or other components of the lavatory system to provide a more visually appealing appearance to lavatory system 10. For example, drain assembly 16 may include a trap or other features that may be visually unappealing or otherwise require a barrier or cover. As such, cover assembly 18 may provide a cleaner, more simplistic appearance relative to other lavatory systems.

According to an exemplary embodiment, basin assembly 12 includes a basin 22, an adapter assembly 24, a cover plate 26, and a fastener 28. Basin 22 includes a bottom portion 30, a backsplash or rear portion 32, a top portion 34, and a flange portion 36 that cooperate to define a contoured wash area and direct water from one or more fixtures to a primary drain passage 38 formed in bottom portion 30 of basin 22. As shown in FIGS. 1 and 4A-4D, bottom portion 30 may provide a generally smooth, contoured (e.g., concave) surface between opposing lateral ends that directs water to one or more drain passages. Rear portion 32 extends generally upward from bottom portion 30 to top portion 34, and top portion 34 extends generally laterally relative to rear portion 32 and extends to flange 36, which is usable to mount basin 22 to an appropriate mounting assembly such as mounting assembly 14. According to an exemplary embodiment, basin 22 is a unitary piece of material that may be cast, formed, molded, or otherwise produced from an appropriate material (e.g., a solid surface, porcelain, an engineered stone, etc.).

Cover plate 26 acts as a strainer or filter to prevent undesirable debris or other materials from entering the primary drain passage 38, and is secured in place by way of fastener 28 or other appropriate means. Drain passage 38 directs water from basin 22 to drain assembly 16. Basin 22 further includes first and second overflow drain passages 40, 42 that fluidly communicate with adapter assembly 24 to form an overflow passage that directs water back to primary drain passage 38.

According to one embodiment, adapter assembly 24 is configured to provide a shallow profile overflow passage. Adapter assembly 24 includes an adapter plate 46 that is fastened to a rear surface of basin 22 by way of one or more fasteners (not shown) and a seal member 48 (e.g., a gasket, o-ring, etc.). Adapter plate 46 includes a body portion 52 having a first side or surface 54 that defines a recess or cavity 56 (e.g., a passage, channel, etc.) and a seal recess or cavity 58 configured to receive seal member 48. One or more apertures 60 may be provided to receive the fasteners that are usable to secure adapter plate 46 to basin 22.

Figure 3A:
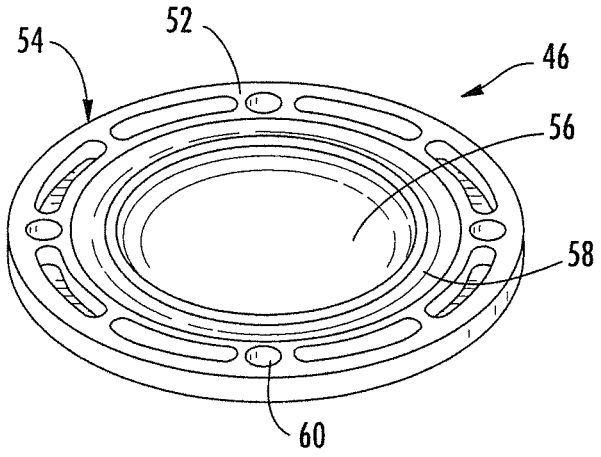
FIG. 3A is a perspective view of an adapter plate according to an exemplary embodiment.
Figure 3C:
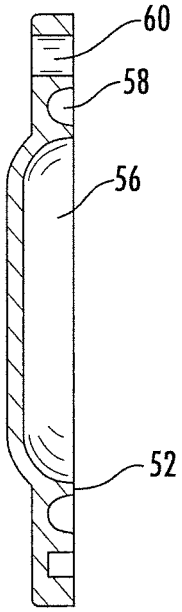
FIG. 3C is a cross-sectional view of the adapter plate of FIG. 3A taken along line B-B of FIG. 3B according to an exemplary embodiment.
Figure 3B:
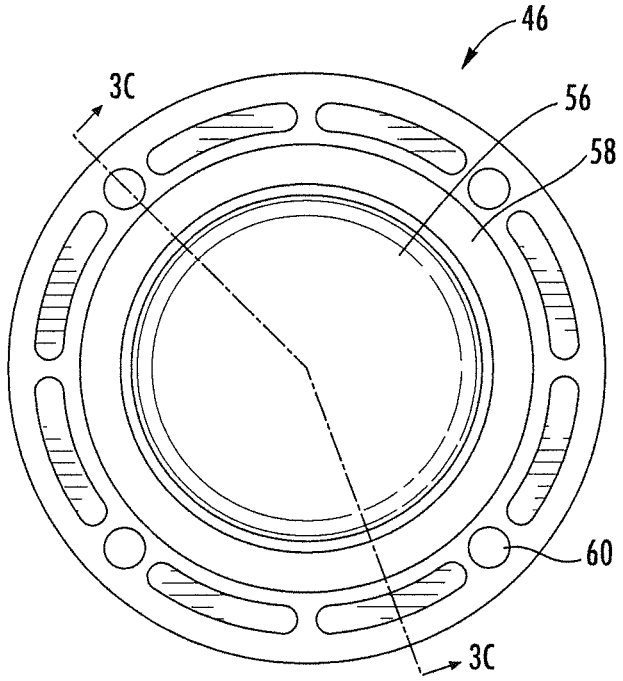
FIG. 3B is a top view of the adapter plate of FIG. 3B according to an exemplary embodiment.
Figure 4A:
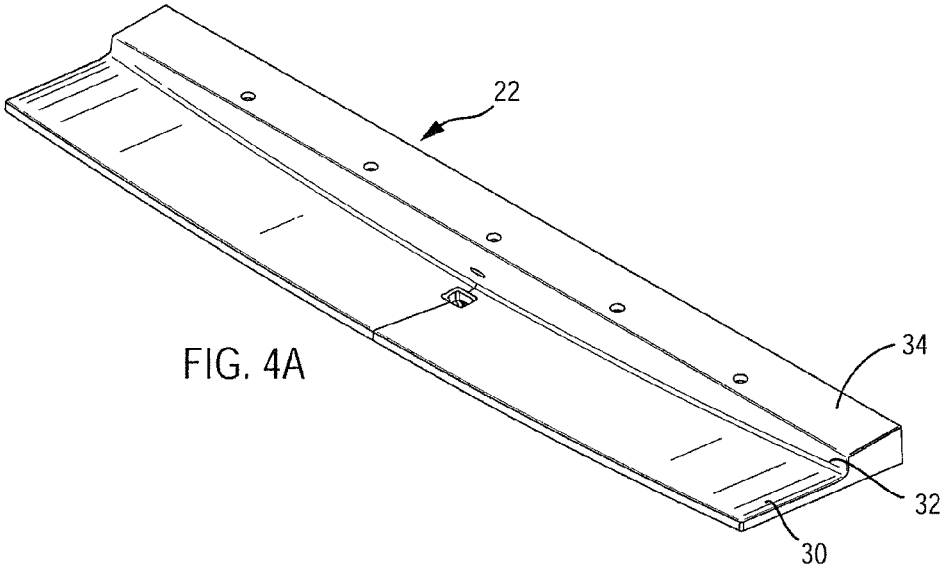
FIG. 4A is a perspective view of a basin according to an exemplary embodiment.
Figure 4B:
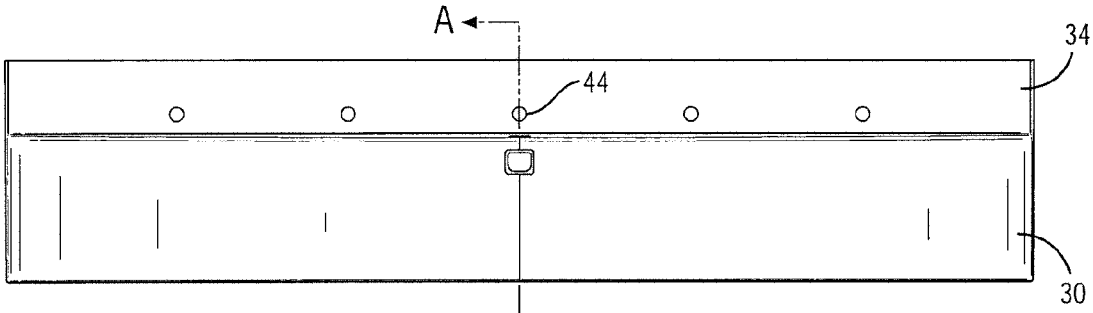
FIG. 4B is a top view of the basin of FIG. 4A according to an exemplary embodiment.
Figure 4C:
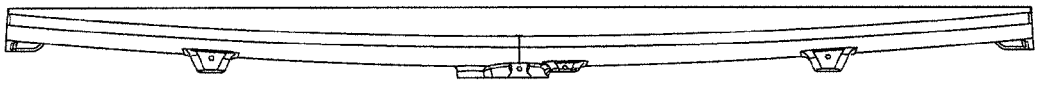
FIG. 4C is a front view of the basin of FIG. 4A according to an exemplary embodiment.
Figure 4D:
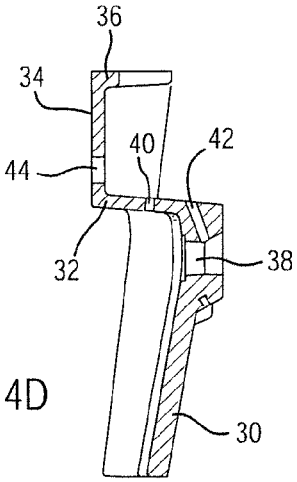
FIG. 4D is a cross-sectional view of the basin of FIG. 4A taken along line A-A of FIG. 4B according to an exemplary embodiment.

Referring to FIGS. 3A-C, adapter plate 46 is shown in further detail. According to an exemplary embodiment, adapter plate 46 is a generally circular, or disk-shaped member having a generally circular periphery. First side 54 of body portion 52 may define a generally flat and/or smooth mounting surface intended to create a water-tight junction with the rear surface of basin 22. According to an exemplary embodiment, seal recess 58 is a circular cavity that extends about the entire periphery of recess 56 to prevent water that is passing through recess 56 (e.g., from first overflow drain passage 40) from leaking out between adapter plate 46 and basin 22. Seal 48 may be any conventional seal, gasket, etc. intended to provide a water-tight connection between components.

Recess 56 may be generally circular in shape, and is sized to provide fluid communication between first overflow passage 40 and second overflow passage 42. In various other embodiments, recess 56 may take other shapes (e.g., oval, irregular-shaped, etc.), sizes, etc. As shown in FIG. 2, first side 54 of adapter plate 46 (e.g., the surface of recess 56) and the rear surface 23 of basin 22 cooperate to form a portion of the overflow drain passage for the lavatory system. In other embodiments, rather than recess 56, a closed channel may be formed in adapter plate 46 such that the wall of basin 22 is not utilized in forming a portion of the overflow drain passage.

As shown in FIG. 2, water or other fluid or materials that enter first overflow passage 40 will be directed to recess 56 of adapter plate 46. Recess 56 directs the water to second overflow passage 42, which in turn directs the water back to primary drain passage 38 in bottom 30 of basin 22. As such, should the water level within basin 22 rise sufficiently to reach first overflow passage 40, water will then enter first overflow passage 40, pass through adapter assembly 24 and second overflow passage 42, and enter primary drain passage 38. These features may help to avoid overflows of basin 22 should, for example, the entrance of primary drain passage 38 become clogged or the water level in basin 22 rise to unusually high levels for other reasons.

During normal use, primary drain passage 38 directs the water to drain assembly 16, which in turn directs the water to a conventional drain system. As shown in FIG. 2, according to an exemplary embodiment, drain system includes a base 64 that mounts to basin 22, and a drain pipe that is configured to fluidly communicate with primary drain passage 38. One or more seals 68 may be utilized to ensure a water-tight, leak-proof junction between base 64 and basin 22.

It should be noted that adapter assembly 24 may provide for a lower profile overflow drain passage relative to the distance from the wall 11 lavatory 10 is mounted on compared to other more conventional designs. In other words, the amount of space that adapter assembly occupies may be relatively less than, for example, a molded overflow drain passage, a drain passage pipe, or similar components that require space for pipe or mold curvatures, etc. This allows for greater flexibility in specifying the distances D1, D2, and D3 shown in FIG. 1. For example, adapter assembly may be relatively shallow, or low-profiled, relative to the rear surface of basin 22, such that adapter assembly extends no more than approximately 0.5 inches from the rear surface of basin 22. In some embodiments, adapter assembly 24 has a maximum thickness, or width, of no more than 0.5 inches, or 0.75 inches. Accordingly, various other components of lavatory system, can in turn be positioned relatively closer to the sink basin and the forwardmost edge of the sink assembly. For example, in some embodiments, the sink assembly is configured to receive a faucet and provide a distance of no more than approximately 11 inches from the center of the faucet outlet to the front of the sink assembly. Further yet, the depth of the basin may be decreased (e.g., the distance between first overflow passage 40 and the bottom of the wash area of basin 12) by not being limited by minimum curvature requirements of molded drain passages, drain piping, etc. As such the depth distance from the first overflow passage 40 to the top of primary drain passage 38 may be for, example, approximately 2 inches, or no more than 2 inches. This distance may vary according to various other embodiments.

In some embodiments, the use of adapter assembly 24 provides for a lavatory system that extends a lesser distance outward from a wall or other structure relative to more conventional designs. For example, top portion 34 may form a "faucet pad" or shelf area intended to provide mounting features for one or more fixtures and enable users to temporarily rest personal items on the faucet pad during use of the lavatory system. In some embodiments, top portion extends from the wall approximately 7 inches. In other embodiments, top portion extends no more than 7 inches from the wall. In yet further embodiments, top portion 34 may extend more or less than 7 inches from the wall. Furthermore, as noted above, the "reach" of the lavatory system (i.e., the distance from the center of a faucet mounted to the sink assembly to the front surface of bottom portion 30) may be approximately 11 inches, or no more than 11 inches.

Figure 5:
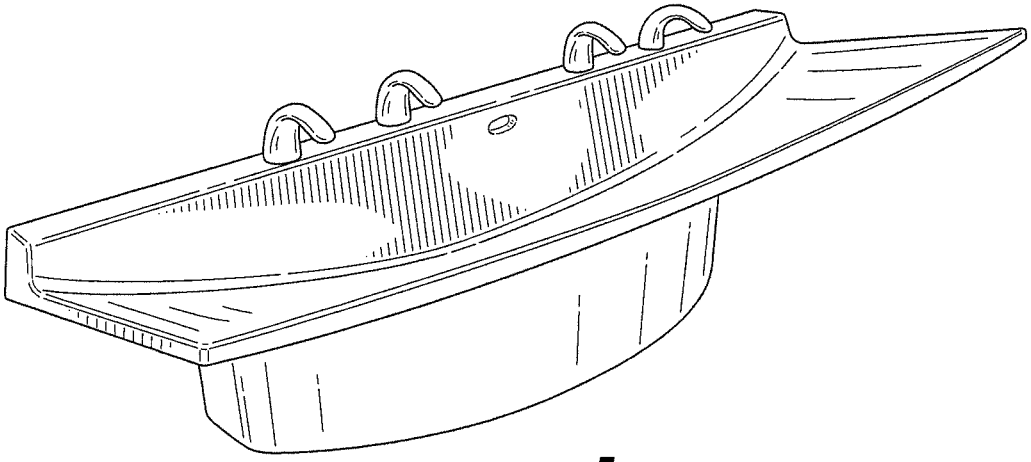
FIGS. 5-6 illustrate lavatory systems according to various other exemplary embodiments that may incorporate one or more features of the lavatory systems and components illustrated in FIGS. 1-4D.
Figure 6:
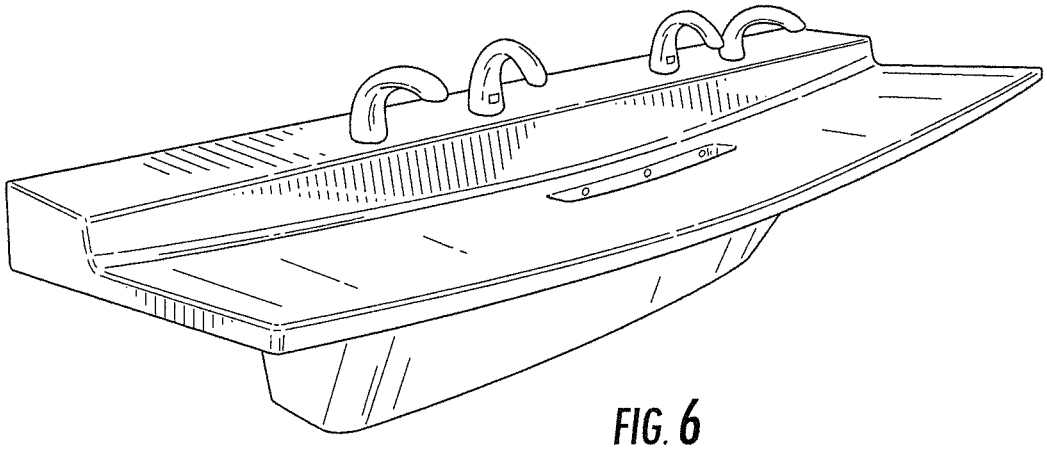

Referring to FIGS. 5 and 6, lavatory systems are illustrated according to alternative embodiments. For example as shown in FIG. 5, in some embodiments, four fixtures such as faucets and/or soap dispensers may be spaced along the top of the basin, and the top of the basin may be relatively narrower along its length. Further, the bottom of the basin in FIG. 5 has a relatively deeper wash area. As shown in FIG. 6, in further embodiments, the cover plate for the main drain passage may be elongated (e.g., rectangular, etc.). The lavatory systems in FIGS. 5 and 6 may incorporate some or all of the components of the lavatory systems described elsewhere herein.

It should be understood that the construction and arrangement of the elements of the lavatory system shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. Some like components have been described in the present disclosure using the same reference numerals in different figures. This should not be construed as an implication that these components are identical in all embodiments; various modifications may be made in various different embodiments. It should be noted that the components and/or assemblies of the lavatory system may be constructed from any of a wide variety of materials that provide sufficient strength or durability, in any of a wide variety of colors, textures, and combinations.

What is claimed is:

1. A lavatory system comprising:

a basin configured to receive at least one faucet, the basin defining a primary drain passage, a first overflow drain passage, and a second overflow drain passage; and an overflow adapter configured to be mounted to a rear surface of the basin, the overflow adapter defining an adapter passage such that when the overflow adapter is mounted to the basin, fluid received by way of the first overflow drain passage is directed through the adapter passage between the overflow adapter and the rear surface of the basin and to the second overflow drain passage.

2. The lavatory system of claim 1, wherein the basin comprises a bottom portion configured to receive fluid from the faucet, a rear portion extending upward from the bottom portion, and a top portion extending generally laterally from the rear portion, the bottom and rear portions defining a rearward facing surface;

wherein the adapter is mounted to the rearward facing surface.

3. The lavatory system of claim 2, wherein the first overflow drain passage is configured to receive fluid when a fluid level in the basin exceeds a predetermined level; and wherein the second overflow drain passage is configured to receive fluid from the adapter passage and direct the water to the primary drain passage.

4. The lavatory system of claim 3, wherein the overflow adapter is a generally circular adapter and the adapter passage is a recess formed in a first side of the overflow adapter and having a generally circular peripheral shape.

5. The lavatory system of claim 4, wherein the overflow adapter comprises a seal cavity extending in a circular manner about the recess in the first side, the seal cavity configured to receive a sealing member configured to form a water-tight seal between the overflow adapter and the basin.

6. The lavatory system of claim 5, wherein the overflow adapter comprises a plurality of through-holes configured to receive fasteners usable to couple the overflow adapter to the basin.

7. The lavatory system of claim 1, wherein the at least one faucet comprises a plurality of faucets.

8. The lavatory system of claim 1, where in the basin is a unitary member defining the primary drain passage and the first and second overflow passages therein.

9. The lavatory system of claim 2, wherein the top portion comprises a flange extending downward and usable to mount the lavatory system to a wall structure.

10. The lavatory system of claim 2, wherein the bottom portion defines an upward-facing concave surface having a continuous smooth contour between opposing lateral ends and between front and rear ends, the upward-facing concave surface configured to direct fluid received from the at least one faucet to the primary drain passage.

11. A lavatory system comprising:

a basin defining a washing area, the basin having a bottom portion and a rear portion having a substantially planar rear surface, wherein the bottom portion defines a primary drain passage, wherein the rear portion defines a first overflow drain passage and a second overflow drain passage, and wherein the second overflow passage extends between the primary drain passage and the substantially planar rear surface;

one or more faucets coupled to the basin and configured to provide fluid to users of the lavatory system; and an adapter assembly coupled to the substantially planar rear surface of the basin, the adapter assembly defining an adapter passage, wherein the adapter passage is configured to receive fluid from the first overflow drain passage and direct fluid to the second overflow drain passage;

wherein the primary drain passage is configured to receive the fluid provided to the adapter assembly from the second overflow drain passage.

12. The lavatory system of claim 11, wherein the adapter assembly is a plate assembly having a generally circular periphery.

13. The lavatory system of claim 12, wherein the adapter assembly is mounted between first and second faucets.

14. The lavatory system of claim 12, wherein the adapter assembly comprises a compressible seal assembly configured to provide a substantially waterproof seal between the basin and the adapter assembly.

15. The lavatory system of claim 11, further comprising a cover assembly configured to conceal at least a portion of the bottom of the basin and the primary drain passage.

16. An adapter assembly usable with a lavatory basin to form an adapter overflow passage, the adapter assembly comprising:

a plate having a substantially flat first side and a generally circular periphery;

a generally circular recess defined by the substantially flat first side and configured to direct fluid between first and second overflow passages of the basin; and a seal assembly of the substantially flat first side, the seal assembly provided between the recess and the periphery of the plate, wherein the seal assembly is configured to prevent the passage of fluid from the recess, and wherein the seal assembly surrounds the first and second overflow passages of the basin.

17. The adapter assembly of claim 16, wherein the generally circular recess is defined by a generally curved outer portion and a generally flat inner portion.

18. The adapter assembly of claim 16, wherein the adapter assembly is a unitary molded member.

19. The adapter assembly of claim 16, wherein a maximum thickness of the body portion is less than about 0.5 inches.

20. The lavatory system of claim 3, wherein the first overflow drain passage includes an inlet and an outlet, wherein the inlet of the first overflow drain passage is proximate with and in fluid communication with the basin such that the inlet of the first overflow drain passage is configured to receive the fluid when the fluid level in the basin exceeds the predetermined level;

wherein the outlet of the first overflow drain passage is proximate to the rearward facing surface and in fluid communication with the adapter passage;

wherein the second overflow drain passage includes an inlet and an outlet, wherein the inlet of the second overflow drain passage is proximate to the rearward facing surface and in fluid communication with the adapter passage such that the inlet of the second overflow drain passage is configured to receive the fluid provided by the adapter passage from the outlet of the first overflow drain passage; and wherein the outlet of the second overflow drain passage is in fluid communication with the primary drain passage.

21. The lavatory system of claim 11, wherein the first overflow drain passage defines an inlet and an outlet, wherein the outlet is defined by the substantially planar rear surface and in fluid communication with the adapter passage; and wherein the second overflow drain passage defines an inlet and an outlet, wherein the inlet is defined by the substantially planar rear surface and is also in fluid communication with the adapter passage.

22. The lavatory system of claim 21, wherein the inlet of the first overflow drain passage is proximate to and in fluid communication with the washing area, and wherein the outlet of the second overflow drain passage is in fluid communication with the primary drain passage.

23. The adapter assembly of claim 16, wherein the first overflow drain passage includes an inlet and an outlet, wherein the inlet of the first overflow drain passage is proximate to and in fluid communication with the basin, and wherein the outlet of the first overflow drain passage is in direct fluid communication with the generally circular recess; and wherein the second overflow drain passage includes an inlet and an outlet, wherein the inlet of the second overflow drain passage is in direct fluid communication with the generally circular recess, and wherein the outlet of the second overflow drain passage is in fluid communication with a primary drain passage of the basin.

* * * * *